US009705171B2

(12) United States Patent
Solomon et al.

(10) Patent No.: US 9,705,171 B2
(45) Date of Patent: Jul. 11, 2017

(54) DIELECTRIC RESONATOR FILTER AND MULTIPLEXER HAVING A COMMON WALL WITH A CENTRALLY LOCATED COUPLING IRIS AND A LARGER PERIPHERAL APERTURE ADJUSTABLE BY A TUNING SCREW

(71) Applicant: Space Systems/Loral, LLC, Palo Alto, CA (US)

(72) Inventors: David Max Solomon, San Mateo, CA (US); Stephen D. Berry, San Ramon, CA (US); Stephen C. Holme, San Ramon, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 140 days.

(21) Appl. No.: 14/681,920

(22) Filed: Apr. 8, 2015

(65) Prior Publication Data

US 2016/0301123 A1 Oct. 13, 2016

(51) Int. Cl.
*H01P 1/20* (2006.01)
*H01P 1/208* (2006.01)

(52) U.S. Cl.
CPC ..... *H01P 1/2084* (2013.01)

(58) Field of Classification Search
CPC ..... H01P 1/2084; H01P 1/2086; H01P 1/20; H01P 7/10
USPC ..... 333/202, 235, 209, 212
See application file for complete search history.

(56) References Cited

U.S. PATENT DOCUMENTS

| | | | | |
|---|---|---|---|---|
| 4,028,651 | A | 6/1977 | Leetmaa | |
| 4,251,787 | A | 2/1981 | Young et al. | |
| 4,489,293 | A * | 12/1984 | Fiedziuszko | H01P 7/105 333/202 |
| 4,652,843 | A * | 3/1987 | Tang et al. | H01P 1/2086 333/212 |
| 4,652,844 | A | 3/1987 | Brambilla | |
| 5,608,363 | A | 3/1997 | Cameron et al. | |
| 5,781,085 | A | 7/1998 | Harrison | |
| 6,297,715 | B1 | 10/2001 | Fiedziuszko et al. | |
| 6,353,373 | B1 | 3/2002 | Liang et al. | |
| 6,535,086 | B1 | 3/2003 | Liang et al. | |
| 8,907,742 | B2 | 12/2014 | Berry et al. | |
| 8,952,769 | B2 | 2/2015 | Berry et al. | |
| 2012/0068792 | A1 | 3/2012 | Yassini et al. | |

* cited by examiner

*Primary Examiner* — Benny Lee
(74) *Attorney, Agent, or Firm* — Weaver Austin Villeneuve & Sampson LLP

(57) ABSTRACT

A radio frequency (RF) dielectric resonator filter includes at least a first cavity and a second cavity, each cavity being loaded with a dielectric resonator. The first cavity is separated from the second cavity by a common wall, the common wall including a first and second aperture that couple an electromagnetic field between the first cavity and the second cavity. A first externally adjustable tuning screw extends from the second aperture, a portion of the tuning screw being external to the filter. The first aperture is an iris disposed in a central portion of the wall and the second aperture is disposed proximate to a perimeter of the wall. The second aperture has an effective area that is adjustable by the first externally adjustable tuning screw.

18 Claims, 7 Drawing Sheets

View A-A

DIELECTRIC RESONATOR FILTER AND MULTIPLEXER HAVING A COMMON WALL WITH A CENTRALLY LOCATED COUPLING IRIS AND A LARGER PERIPHERAL APERTURE ADJUSTABLE BY A TUNING SCREW

TECHNICAL FIELD

This invention relates generally to microwave cavity filters, and more particularly to a dual mode dielectric resonator loaded cavity filter.

BACKGROUND

The assignee of the present invention manufactures and deploys spacecraft for, inter alia, communications and broadcast services from geosynchronous orbit. A substantial number of radio frequency (RF) filters are required in such spacecraft. For example, a satellite input multiplexor (IMUX) may utilize a number of microwave channel filters, each filter having the functionality of separating and isolating a specific respective signal or bandwidth frequency from a broadband uplink signal received by a spacecraft antenna.

IMUX channel filters are required to exhibit high selectivity and high Q. These filters may include a plurality of cylindrical cavities, each cavity including an internally disposed disk-like dielectric resonator (or "puck") to improve filter Q relative to physical size and bandwidth. Such filters are described, for example in U.S. Pat. Nos. 6,297,715, 8,907,742, and 8,952,769 assigned to the assignee of the present invention, the disclosure of each which is hereby incorporated by reference into the present application for all purposes.

The filter may operate in dual mode (e.g., HE11 mode) and each cavity of the filter may be coupled to at least one adjacent cavity via a respective aperture (or "iris") that enable the HE11 field to couple between the cavities. The iris may have a slot-like configuration with a large aspect ratio of length to width. The iris may be disposed in a central portion of a common wall separating two adjacent cavities. The iris should be optimally sized in order for the filter to meet specified requirements. The optimal dimensions are difficult to predict. Moreover, dimensional variations resulting from machining tolerances can significantly affect filter performance.

In the absence of the present teachings, fabrication and testing of multiple common walls, each including an iris, the irises each varying slightly in size, may be necessary to find an iris size that provides the best performance.

SUMMARY OF THE INVENTION

The present inventors have appreciated that electrical/magnetic coupling between adjacent cavities of a multicavity RF filter may advantageously be made adjustable by way of an auxiliary aperture disposed near a perimeter of a common wall separating two adjacent cavities effective area of the auxiliary aperture may be adjusted by way of an externally adjustable tuning screw.

According to some implementations, a radio frequency (RF) dielectric resonator filter includes at least a first cavity and a second cavity, and a first externally adjustable tuning screw. Each cavity is loaded with a dielectric resonator, the first cavity being separated from the second cavity by a common wall, the common wall including a first and second aperture that couple an electromagnetic field between the first cavity and the second cavity. The first externally adjustable tuning screw extends from the second aperture, a portion of the tuning screw being external to the filter. The first aperture is an iris disposed in a central portion of the wall and the second aperture is disposed proximate to a perimeter of the wall. The second aperture has an effective area that is adjustable by the first externally adjustable tuning screw.

In some examples, the iris may have a slot-like configuration. In some examples, the iris may have a square, rectangular, circular or cruciform shape.

In some examples, the filter may include a second externally adjustable tuning screw, the common wall including a third aperture, the third aperture having an effective area that is adjustable by the second externally adjustable tuning screw.

In some examples, the second aperture may be a rectangular slot formed at an edge of the common wall.

In some examples, each dielectric resonator may have a respective longitudinal axis, the respective longitudinal axes being substantially coaxial. In some examples, each cavity may have a respective longitudinal axis and characteristic diameter, the respective longitudinal axes being substantially parallel and separated by a distance greater than the characteristic diameter.

In some examples, the filter may include a multi-cavity metallic housing, the housing comprising a plurality of walls that define a plurality of resonator cavities.

According to some implementations, a multiplexer includes at least two channel filters and a first externally adjustable tuning screw. Each channel filter is a bandpass dielectric resonator filter, including at least a first cavity and a second cavity, each cavity being loaded with a dielectric resonator, the first cavity being separated from the second cavity by a common wall, the common wall including a first and second aperture that couple an electromagnetic field between the first cavity and the second cavity. The first externally adjustable tuning screw extends from the second aperture, a portion of the tuning screw being external to the filter. The first aperture is an iris disposed in a central portion of the wall and the second aperture is disposed proximate to a perimeter of the wall. The second aperture has an effective area that is adjustable by the first externally adjustable tuning screw.

According to some implementations, an improved radio frequency (RF) filter includes at least a first cavity and a second cavity, each cavity being loaded with a dielectric resonator, the first cavity being separated from the second cavity by a wall, the wall including a first aperture that couples an electromagnetic field between the first cavity and the second cavity. The improvement comprises: a second aperture disposed proximate to a perimeter of the wall and a first externally adjustable tuning screw that extends from the second aperture, a portion of the tuning screw being external to the filter. The second aperture has an effective area that is adjustable by the first adjustable tuning screw.

BRIEF DESCRIPTION OF THE DRAWINGS

Features of the invention are more fully disclosed in the following detailed description of the preferred embodiments, reference being had to the accompanying drawings, in which.

Figure 1:
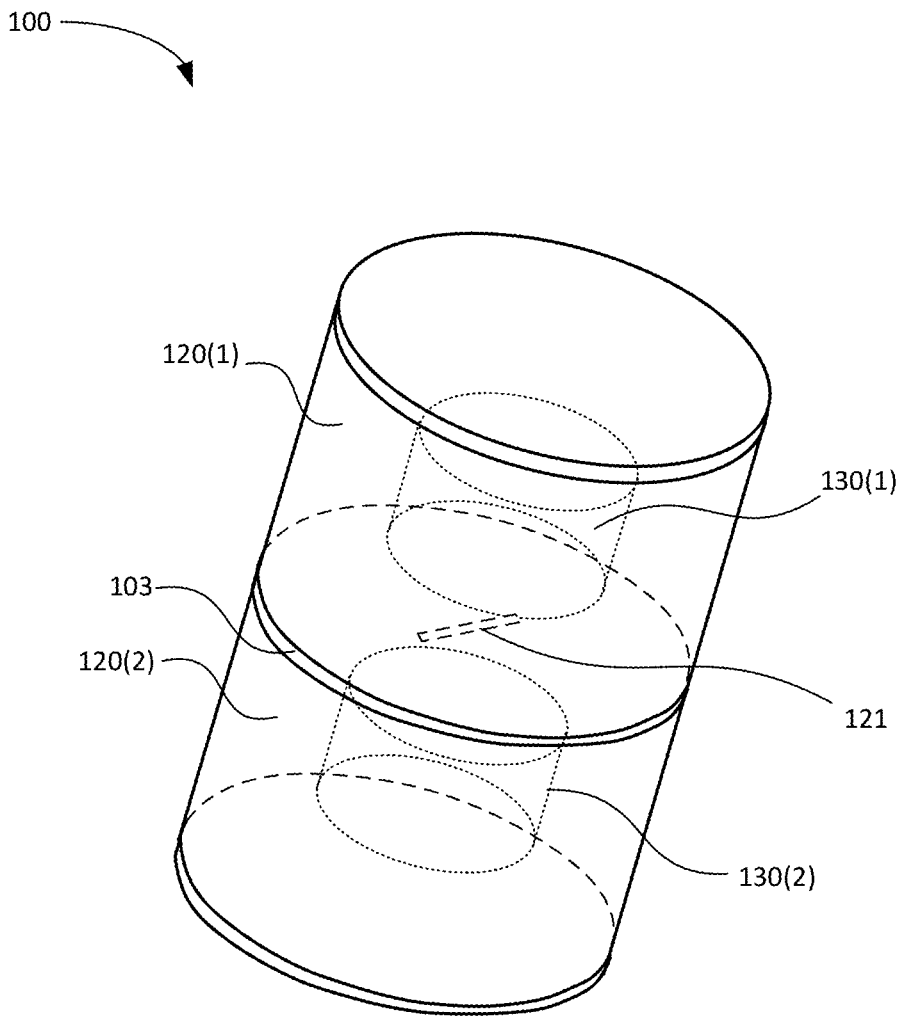
FIG. 1 illustrates a dielectric resonator filter including two resonator cavities.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION OF THE INVENTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when a feature is referred to as being "connected" or "coupled" to another feature, it can be directly connected or coupled to the other feature, or intervening features may be present. Furthermore, "connected" or "coupled" as used herein may include wirelessly connected or coupled. It will be understood that although the terms "first" and "second" are used herein to describe various features, these features should not be limited by these terms. These terms are used only to distinguish one feature from another feature. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

Referring to FIG. 1, a dielectric resonator filter 100 may include at least two resonator cavities, each resonator cavity containing a disk-like dielectric resonator. Adjacent resonator cavities 120(1) and 120(2), respectively containing dielectric resonators 130(1) and 130(2) may be coupled to one another via an aperture provided in a common wall 103 disposed between the adjacent resonator cavities. In the illustrated example, iris 121 provides an electromagnetic field coupling between resonator cavity 120(1) and resonator cavity 120(2). The iris 121 may have, as illustrated, a slot-like form factor with a large aspect ratio of length to width, however circular, square, rectangular, or cruciform shaped irises are also within the contemplation of the present disclosure. The iris 121 may be disposed in a central portion of the common wall 103. As indicated hereinabove, in the absence of the present teachings, therefore, fabrication and testing of multiple common walls, each including an iris, the irises each varying slightly in size, may be necessary to find an iris size that provides the best performance.

Figure 2:
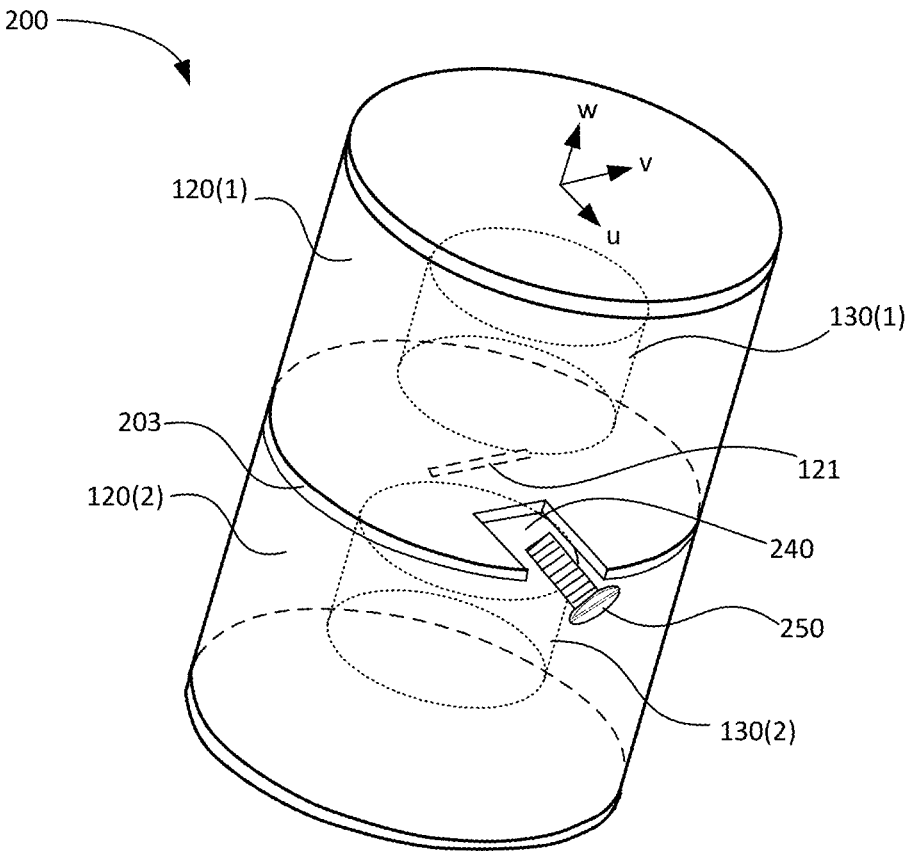
FIG. 2 illustrates a dielectric resonator filter including two resonator cavities according to an implementation.
Figure 3:
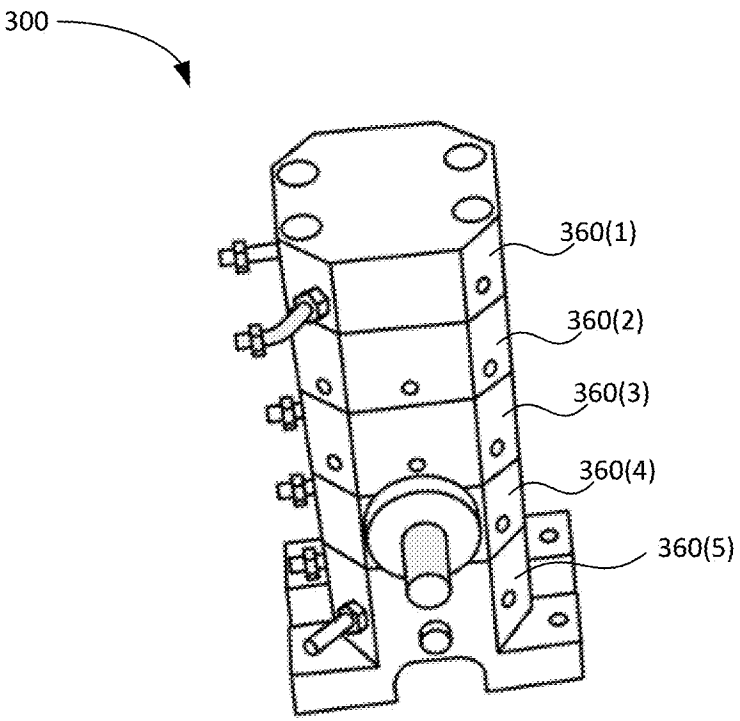
FIG. 3 is an external view of a multicavity dielectric resonator filter including five resonator cavities, according to an implementation.

Referring now to FIG. 2, a dielectric resonator filter 200 is illustrated in which, in addition to the centrally disposed iris 121, an auxiliary aperture 240 is disposed proximate to an outer edge or perimeter of a common wall 203. In some implementations, the auxiliary aperture 240 may be a machined rectangular slot and be configured to allow access for an externally adjustable tuning screw 250. The externally adjustable tuning screw 250 may be configured to provide a fine adjustment of the effective area of the auxiliary aperture 240. As a result, the characteristic bandwidth of the coupling between two adjacent cavities 120(1) and 120(2) may be adjusted and optimized notwithstanding that the dimensions of the centrally disposed iris 121 may be fixed and not necessarily optimal In the example implementation illustrated in FIG. 2, two dielectric resonators 130(1) and 130(2) are disposed in respective resonator cavities 120(1) and 120(2) which are separated by a single common wall 203. It will be appreciated that three or more dielectric resonator cavities may be stacked. For example, referring to FIG. 3, filter 300 includes a stack of five dielectric resonator cavities, each dielectric resonator cavity disposed within a respective housing. Each respective housing 360(1), 360(2), 360(3), 360(4), and 360(5) may include provisions for one or more tuning screws 250 (FIG. 2). In the illustrated implementation, the stack of dielectric resonator cavities may be arranged such that a respective longitudinal axis 'w', orthogonal to a first transverse axis 'u' and a second transverse axis 'v', of each dielectric resonator cavity is, mutually, substantially coaxial.

Figure 4:
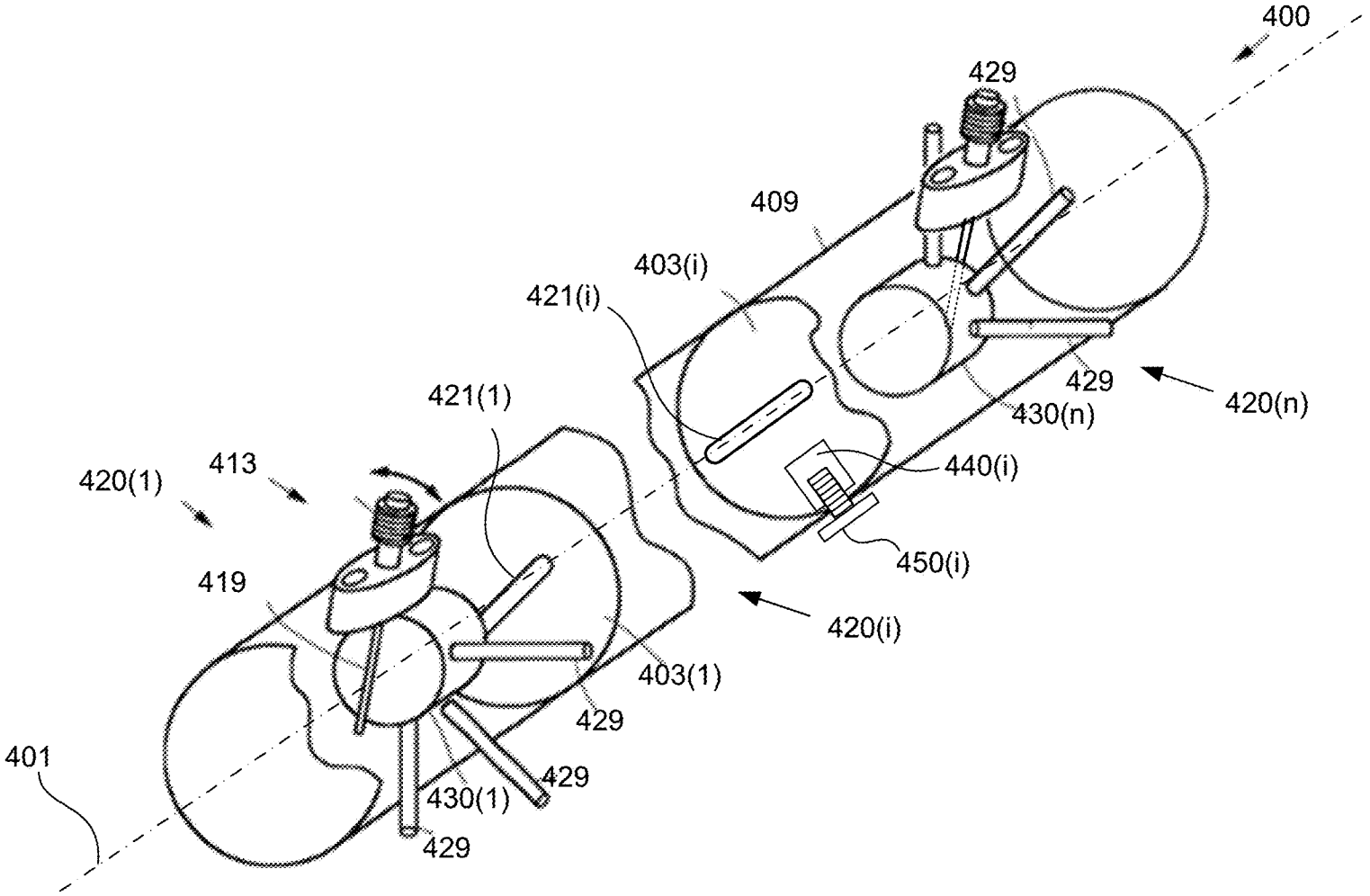
FIG. 4 is a sectional view of a multicavity dielectric resonator filter according to an implementation.

FIG. 4 illustrates a yet further implementation of a dielectric resonator filter. In the illustrated implementation, a filter 400 is a multi-cavity filter including an input cavity 420(1), an output cavity **420(*n*), and one or more intermediate cavities 420(*i*) disposed between the input cavity 420(1) and the output cavity 420(*n*). The cavities 420(1), 420(*i*) and 420(*n*) may all be electrically defined within a short length of a cylindrical waveguide 409 by a series of spaced common walls 403(*i*), each wall 403(*i*) being disposed transversely to a longitudinal axis 401 of the cylindrical waveguide 409**.

Input/output coupling device in the form of a probe assembly or connector 413 may be used to couple microwave energy from/to an external source (not illustrated) relative to the input/output cavities **420(1)/420(*n*). For example, microwave energy coupled to a probe 419 may be radiated therefrom into the input cavity 420(1). Microwave energy may be coupled from the input cavity 420(1) into an adjacent intermediate cavity 420(*i*) by a first aperture 421(1) disposed in a central portion of common wall 403(1). A cylindrical dielectric resonator, for example, dielectric resonator 430(1) and 430(*n*), may be respectively disposed in cavities 420(1), and 420(*n*)**. Each dielectric resonator may be mounted within a respective cavity by one or more insulative mounting elements (not illustrated) that may take the form of pads or short columns of low loss insulator material such as polystyrene or rexolite, for example.

Each dielectric resonator, together with the respective cavity within which it is disposed, may form a composite resonator having axial symmetry. In some implementations, one or more cavities have an associated one or more tuning screws 429 that project into the cavity. At least some common walls 403(*i*) may include, as illustrated, an auxiliary aperture 440(*i*). Similarly to iris 421(*i*), the auxiliary aperture 440(*i*) may provide a coupling of microwave energy between adjacent cavities sharing common wall 403(*i*). The magnitude of the coupling may depend on an effective area of the auxiliary aperture 440(*i*). An effective area of the auxiliary aperture 440(*i*) may be varied by controlling a penetration depth of an adjustable tuning screw 450(*i*). As a result, the characteristic bandwidth of the coupling between two adjacent cavities can be adjusted and optimized notwithstanding that the dimensions of the iris 421(*i*) may be nonadjustable and not necessarily optimal.

Figure 5:
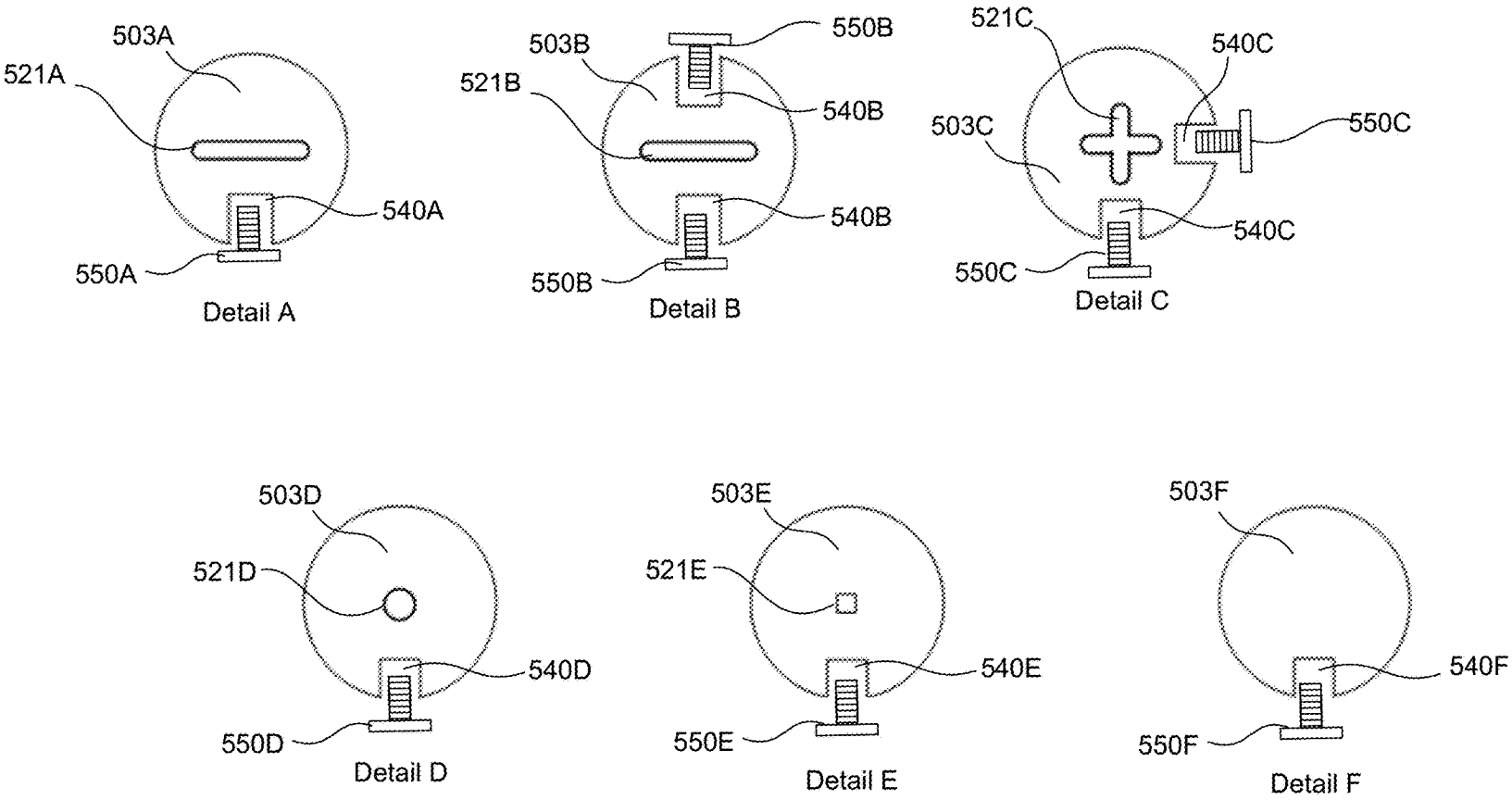
FIG. 5 illustrates some example implementations of a common wall together with one or more adjustable tuning screws according to some implementations.

FIG. 5 illustrates some example implementations of a common wall together with one or more adjustable tuning screws. Referring to Detail A, a common wall 503A includes an iris 521A configured as an elongated slot where the auxiliary aperture 540A and an externally adjustable tuning screw 550A are disposed on a side of the common wall 503A proximate to a long edge of the iris 521A. Referring to Detail B, a common wall 503B includes a similarly configured iris 521B where auxiliary apertures 540B and adjustable tuning screws 550B are disposed at opposite sides of the common wall 503B. Detail C illustrates an arrangement where a common wall 503C includes an iris 521C that is configured in a cruciform shape and a pair of auxiliary apertures 540C and adjustable tuning screws 550C are spaced at a 90° angular separation. Detail D illustrates an implementation where a common wall 503D includes an iris 521D that is substantially circular and where auxiliary aperture 540D and an externally adjustable tuning screw 550D are disposed on a side of the common wall 503D. Detail E illustrates an implementation where a common wall 503E includes an iris 521E that is substantially square and where auxiliary aperture 540E and an externally adjustable tuning screw 550E are disposed on a side of the common wall 503E. Detail F illustrates an implementation where a common wall 503F omits a centrally disposed iris and includes instead only auxiliary aperture 540F with adjustable tuning screw 550F to realize very small couplings.

Figure 6:
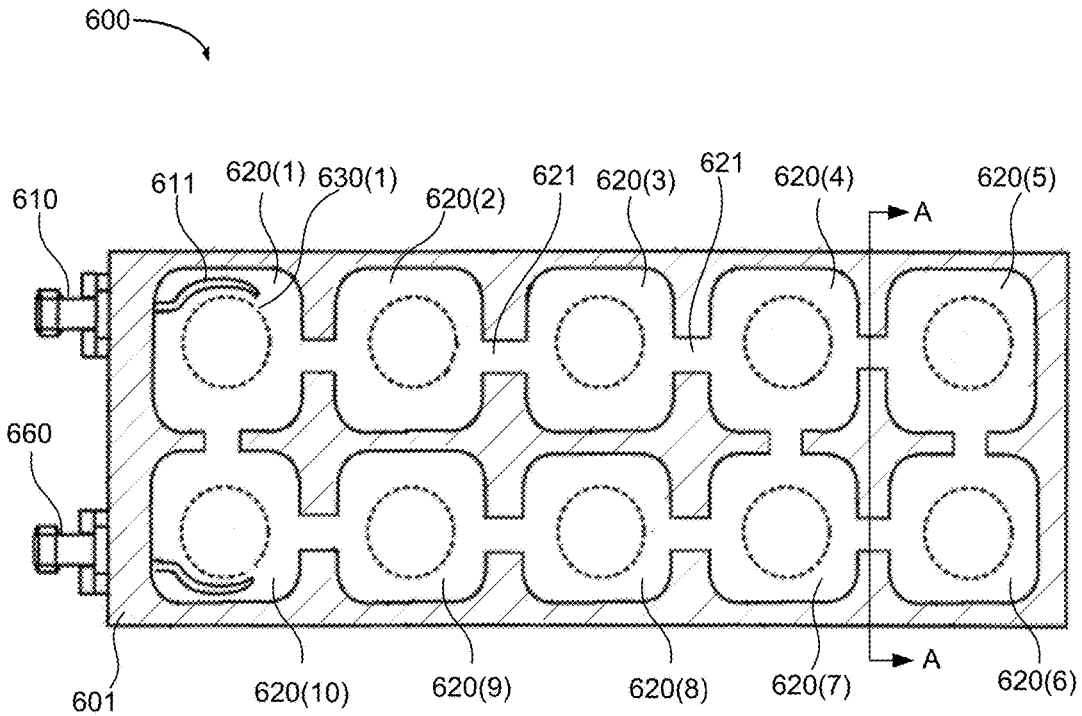
FIG. 6 illustrates a multicavity microwave filter according to an implementation.
Figure 6:
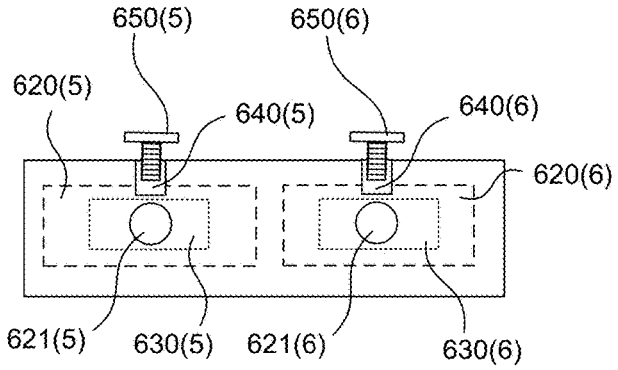

The presently disclosed techniques may also be adapted to a multicavity microwave filter in which dielectric loaded cavities are arranged in a side-by-side manner as described in U.S. Pat. No. 5,608,363, incorporated herein by reference in its entirety for all purposes and U.S. Pat. No. 8,907,742. For example, referring to FIG. 6, RF filter 600 may include a housing 601. An input port 610 may be coupled by probe 611 to a first resonator cavity 620(1) which is loaded with dielectric resonator 630(1). A sequential series of such resonator cavities (e.g., resonator cavities 620(2), 620(3), 620(4), 620(5), 620(6), 620(7), 620(8), 620(9), may be provided. For example, in the illustrated implementation, ten resonator cavities are disposed such that the first resonator cavity in the series 620(1) is proximal to the input port 610, and the last resonator cavity in the series, resonator cavity 620(10) is disposed proximate to an output port 630. Each resonator cavity of the filter may be coupled to at least one adjacent cavity via a respective iris (for example, iris 621(5) and 621(6) of View A-A) that enable electromagnetic field to couple between the adjacent cavities. As may be observed in View A-A, the housing 601 may be configured so as to provide an auxiliary aperture (in View A-A, auxiliary aperture 640(5) and auxiliary aperture 640(6) between adjacent resonator cavities (in View A-A, cavity 620(5) and cavity 620(6), loaded, respectively, with dielectric resonator 630(5) and dielectric resonator 630(6). An effective area of the auxiliary apertures 640(5) and 640(6) may be respectively varied by controlling a penetration depth of adjustable tuning screws 650(5) and 650(6). As a result, the characteristic bandwidth of the coupling between two adjacent cavities may be adjusted and optimized notwithstanding that the dimensions of iris 621(5) and/or iris 621(6) may be nonadjustable and not necessarily optimal.

Figure 7:
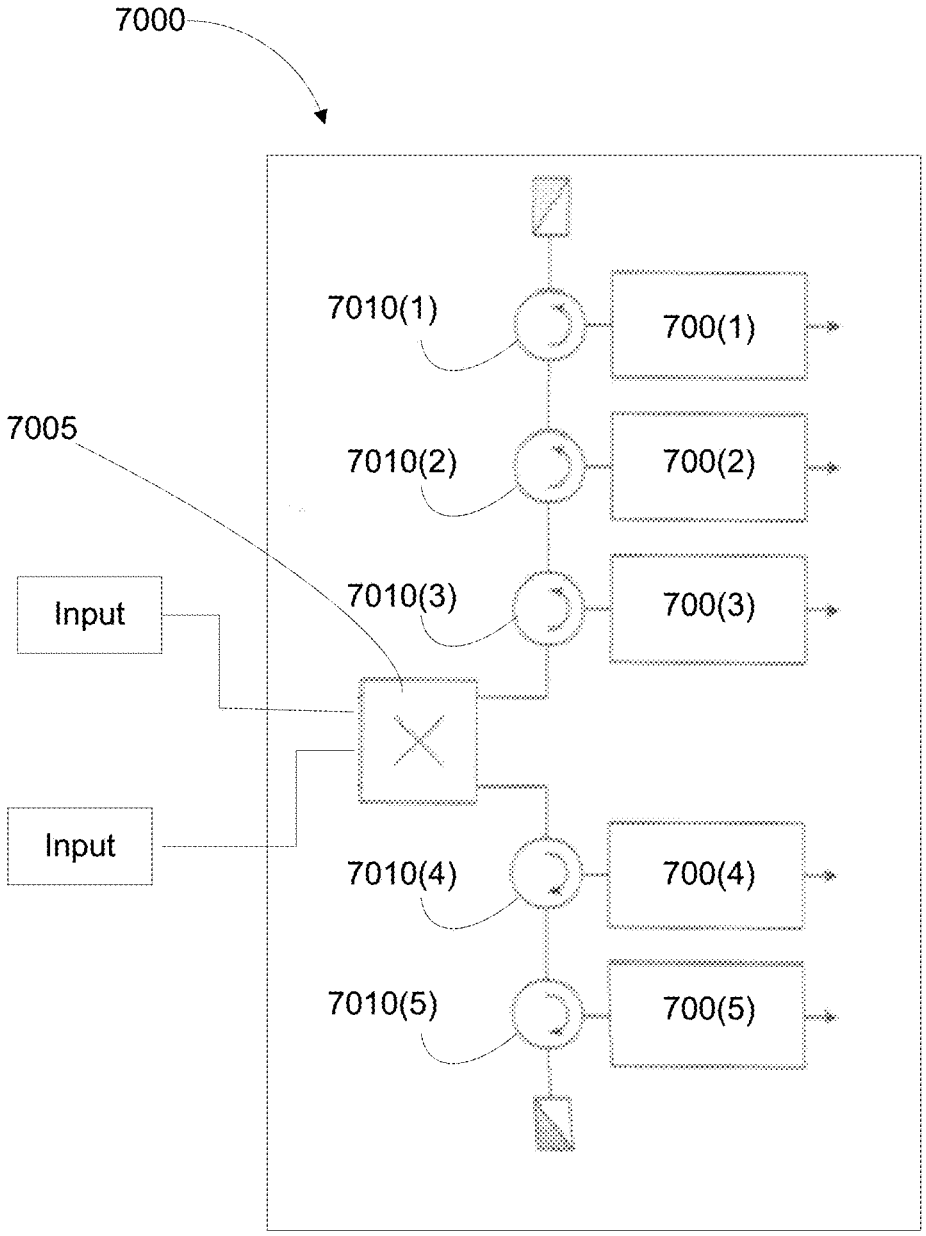
FIG. 7 illustrates an input multiplexer according to an implementation.

FIG. 7 shows an example of an input multiplexer 7000, configured in accordance with some implementations. Input multiplexer 7000 may include a hybrid 7005 that is configured to receive input RF energy from one or more receivers. For example, inputs from an operational receiver and a redundant receiver may be received by hybrid 7005. In an implementation, the hybrid 7005 may be a 3-dB hybrid. In the illustrated implementation, the input multiplexer 7000 includes five channel filters 700(1), 700(2), 700(3), 700(4), and 700(5), however a smaller or larger number of channel filters may be contemplated. Between hybrid 7005 and each channel filter 700(1), 700(2), 700(3), 700(4), and 700(5) may be disposed a respective circulator 7010(1), 7010(2), 7010(3), 7010(4), and 7010(5).

Each channel filter may be configured to output RF energy at a respective wavelength $\lambda_i$. For example, channel filter 700(1) may be configured to output RF energy at a wavelength $\lambda_1$.

One or more of the respective channel filters may be a multi-cavity RF filter configured as described hereinabove. More particularly, one or more of the channel filters may include a common wall disposed between two adjacent cavities, the common wall including a centrally disposed aperture, and an auxiliary aperture, the auxiliary aperture having an effective area that is adjustable by way of an externally adjustable tuning screw.

Thus tunable irises for a dielectrically loaded microwave filter have been disclosed. The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. A radio frequency (RF) dielectric resonator filter, comprising:

at least a first cavity and a second cavity, each cavity being loaded with a respective dielectric resonator, the first cavity being separated from the second cavity by a common wall, the common wall including a first and second aperture that couple an electromagnetic field between the first cavity and the second cavity; and a first externally adjustable tuning screw that extends from the second aperture, a portion of the tuning screw being external to the filter; wherein the first aperture is an iris disposed in a central portion of the common wall and the second aperture is disposed proximate to a perimeter of the common wall;

the second aperture is larger than the first aperture; and the second aperture has an effective area that is adjustable by the first externally adjustable tuning screw.

2. The filter of claim 1, wherein the iris has a slot-like configuration.

3. The filter of claim 1, wherein the iris has a square, rectangular, circular or cruciform shape.

4. The filter of claim 1, further comprising a second externally adjustable tuning screw, the common wall including a third aperture, the third aperture having an effective area that is adjustable by the second externally adjustable tuning screw.

5. The filter of claim 1, wherein the second aperture is a rectangular slot formed at an edge of the common wall.

6. The filter of claim 1, wherein each dielectric resonator has a respective longitudinal axis, the respective longitudinal axes being substantially coaxial.

7. The filter of claim 1, wherein the first cavity and the second cavity are arranged in a side-by-side manner.

8. A multiplexer comprising:

at least two channel filters, wherein:

each channel filter is a bandpass dielectric resonator filter, comprising:

at least a first cavity and a second cavity, each cavity being loaded with a respective dielectric resonator, the first cavity being separated from the second cavity by a common wall, the common wall including a first and second aperture that couple an electromagnetic field between the first cavity and the second cavity; and a first externally adjustable tuning screw that extends from the second aperture, a portion of the tuning screw being external to the filter; wherein the first aperture is an iris disposed in a central portion of the common wall and the second aperture is disposed proximate to a perimeter of the common wall;

the second aperture is larger than the first aperture; and the second aperture has an effective area that is adjustable by the first externally adjustable tuning screw.

9. The multiplexer of claim 8, wherein the first cavity and the second cavity are arranged in a side-by-side manner.

10. The multiplexer of claim 8, wherein at least one of the at least two channel filters includes a second externally adjustable tuning screw, the common wall including a third aperture, the third aperture having an effective area that is adjustable by the second externally adjustable tuning screw.

11. The multiplexer of claim 8, wherein each dielectric resonator has a respective longitudinal axis, the respective longitudinal axes being substantially coaxial.

12. An improved radio frequency (RF) filter, the RF filter including at least a first cavity and a second cavity, each cavity being loaded with a respective dielectric resonator, the first cavity being separated from the second cavity by a wall, the wall including a first aperture that couples an electromagnetic field between the first cavity and the second cavity;

wherein the improvement comprises:

a second aperture disposed proximate to a perimeter of the wall and a first externally adjustable tuning screw that extends from the second aperture, a portion of the tuning screw being external to the filter; wherein the second aperture is larger than the first aperture and the second aperture has an effective area that is adjustable by the first adjustable tuning screw.

13. The improved radio frequency RF filter of claim 12, wherein the first cavity and the second cavity are arranged in a side-by-side manner.

14. The improved radio frequency RF filter of claim 12, wherein each dielectric resonator has a respective longitudinal axis, the respective longitudinal axes being substantially coaxial.

15. The improved radio frequency RF filter of claim 12, wherein the iris has a slot-like configuration.

16. The improved radio frequency RF filter of claim 12, wherein the iris has a square, rectangular, circular or cruciform shape.

17. The improved radio frequency RF filter of claim 12, further comprising a second externally adjustable tuning screw, the wall including a third aperture, the third aperture having an effective area that is adjustable by the second externally adjustable tuning screw.

18. The improved radio frequency RF filter of claim 12, wherein the second aperture is a rectangular slot formed at an edge of the wall.

* * * * *